United States Patent [19]

Muth et al.

[11] Patent Number: 4,738,054

[45] Date of Patent: Apr. 19, 1988

[54] CEILING ACCESS DOOR ASSEMBLY

[75] Inventors: James C. Muth; Otto E. Kersten, Jr., both of Milwaukee, Wis.; Gregory A. Kulpa, South Pasadena, Calif.

[73] Assignee: Milcor Incorporated, Lima, Ohio

[21] Appl. No.: 799,140

[22] Filed: Nov. 18, 1985

[51] Int. Cl.[4] ..... E05F 1/10

[52] U.S. Cl. ..... 49/386; 49/401; 52/204

[58] Field of Search ..... 49/401, 402, 386, 394; 182/77, 47; 52/208, 204, 205

[56] References Cited

U.S. PATENT DOCUMENTS

| | | | |
|---|---|---|---|
| 877,363 | 1/1908 | Nielsen . | |
| 1,114,271 | 10/1914 | Kundtz | 49/401 |
| 1,188,395 | 6/1916 | Bessler . | |
| 1,700,904 | 2/1929 | Marschke . | |
| 1,721,521 | 7/1929 | Marschke . | |
| 1,731,980 | 10/1929 | Marschke . | |
| 1,767,148 | 6/1930 | Marschke . | |
| 1,883,777 | 10/1932 | Frazier . | |
| 2,095,392 | 10/1937 | Marschke . | |
| 2,163,142 | 6/1939 | Frazier . | |
| 2,196,546 | 4/1940 | Bowers . | |
| 2,314,004 | 3/1943 | Marschke . | |
| 2,927,353 | 3/1960 | Snitker | 49/394 |
| 4,133,074 | 1/1979 | Schack | 49/386 |
| 4,227,345 | 10/1980 | Durham | 49/181 |
| 4,299,059 | 11/1981 | Smith | 182/47 |

*Primary Examiner*—Kenneth J. Dorner
*Assistant Examiner*—Gerald A. Anderson
*Attorney, Agent, or Firm*—Marshall, O'Toole, Gerstein, Murray & Bicknell

[57] ABSTRACT

This disclosure relates to an access door assembly for a ceiling. The assembly includes a frame adapted to be attached to supports of the ceiling and mounted in a generally horizontal position, and a door which fits within and has one edge hingedly connected to the frame. The hinge enables the door to swing between a generally horizontal closed position within the frame and a lowered open position. A constant-force return spring urges the door to the closed position, and an automatically engageable lock is provided for holding the door in the closed position. The frame and the door have closely adjacent Z-shaped frame members and the door is made of heat-resistant material, to form a fire retardant construction.

4 Claims, 3 Drawing Sheets

CEILING ACCESS DOOR ASSEMBLY

FIELD AND BACKGROUND OF THE INVENTION

This invention relates broadly to a building construction, and more specifically to an access door assembly for a fire resistive floor/ceiling assembly of a building.

It is customary in modern buildings to make the floors of reinforced concrete or other material and to install the "utilities" in and below the floor. The utilities include, for example, plumbing, air ducts, cummunication, computer and electrical wiring. A ceiling or membrane is normally mounted below the utilities in order to separate the utilities from the space of the floor below.

In the past, "access doors" have also been provided in the ceiling which enable technicians to reach the utilities from the floor below, in order to service or modify them. Such an access door is described, for example, in U.S. Pat. No. 4,098,024 dated July 4, 1978. In the past, the primary requirement of the door design has been merely that it have an acceptable appearance and provide access to the space above.

It would be advantageous for such a door to also have fire or heat protection capability. Where the ceiling is made of a fire retardant material such as gypsum, it would be desirable to have the door capable of meeting at least the rating of the ceiling in order to maintain the fire rating of the floor/ceiling assembly. Such a door would be required to pass a fire test similar to the test required for a fire resistive floor/ceiling assembly. Fire protection capability is, of course, desirable in order to keep the fire from spreading to other locations and to protect the utilities from damage in the event of a fire in the floor space below.

It is therefore a general object of this invention to provide an improved ceiling access door assembly which has both an acceptable appearance and fire protection capability.

BRIEF SUMMARY OF THE INVENTION

An access door assembly in accordance with this invention comprises a mounting frame adapted to be attached to supports of a ceiling in a generally horizontal position, and a door which fits within and has one edge hingedly connected to the frame. The hinge enables the door to swing between a generally horizontal closed position within the frame and a lowered open position. A return spring urges the door to the closed position, and an automatically engageable lock is provided for holding the door in the closed position. The mounting frame and the door have closely adjacent Z-shaped frame members and form a tortuous path between the door and the frame, and the door is made of heat-resistant material, to form a fire retardant construction.

BRIEF DESCRIPTION OF THE DRAWINGS

The invention will be better understood from the following detailed description taken in conjunction with the accompanying figures of the drawings, wherein.

DETAILED DESCRIPTION OF THE DRAWINGS

Figure 4:
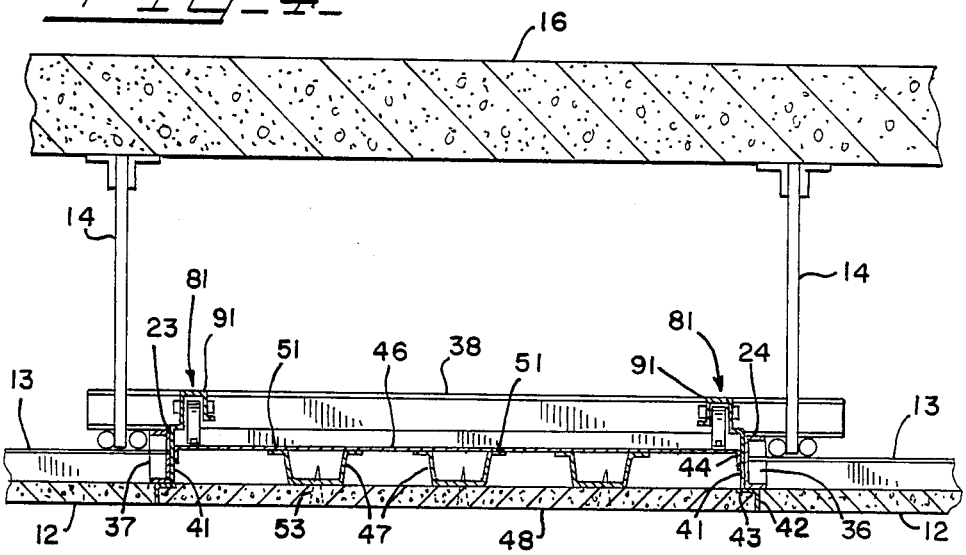
FIG. 4 is a sectional view showing the access door assembly mounted in a ceiling.

The invention relates to a door mounting frame 10 and a door 11, the frame and door assembly being adapted to be mounted in a ceiling shown in FIG. 4. With reference to FIG. 4, the ceiling is formed by ceiling panels 12 secured to the undersides of channels 13. The channels 13 in turn are supported by bar joists 14 attached to the underside of a concrete slab 16. The channels 13 and the joists 14 are, in this example, made of metal and the ceiling panels 12 are preferably made of a fire-resistant material such as gypsum drywall. The foregoing arrangement of the ceiling panels and channels, the joists and the concrete slab may be conventional. The utilities (not shown) are mounted in the space between the slab 16 and the panels 12.

Figure 5:
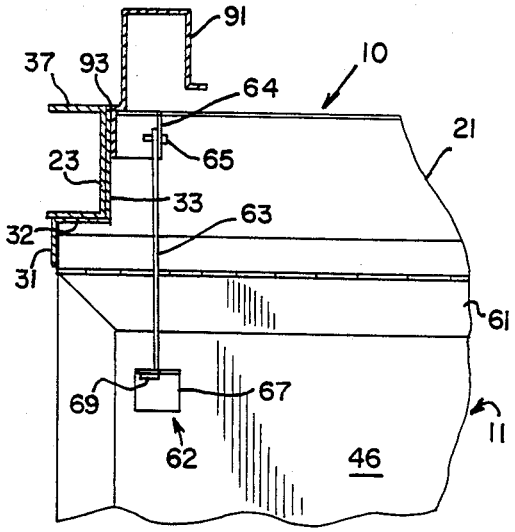
FIG. 5 is an enlarged fragmentary sectional view taken on the line 5—5 of FIG. 1.
Figure 6:
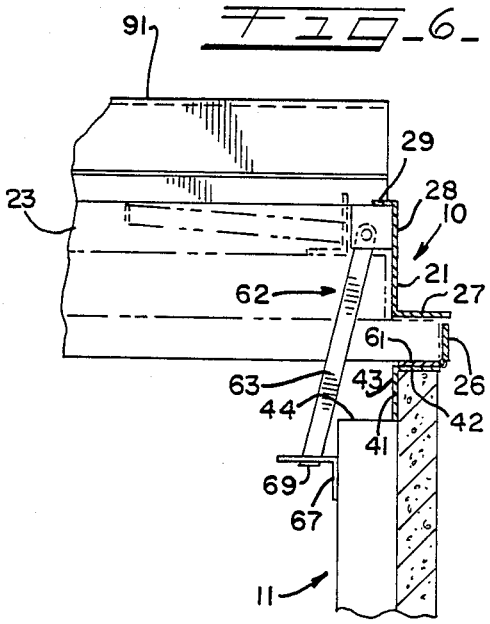
FIG. 6 is an enlarged fragmentary sectional view taken on the line 6—6 of FIG. 4.
Figures 8, 9:
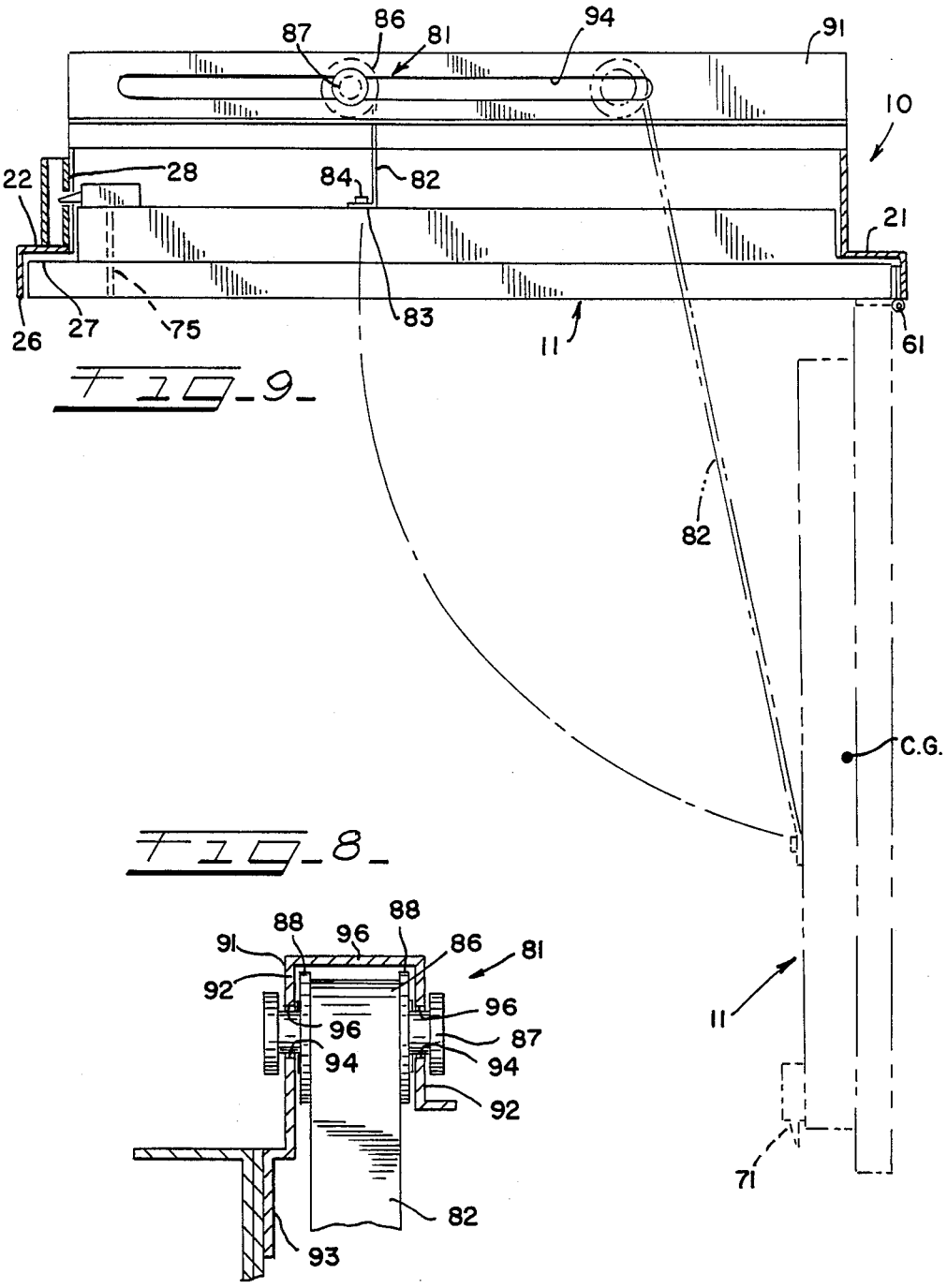
FIG. 8 is an enlarged fragmentary sectional view taken on the line 8—8 of FIG. 1.
FIG. 9 is a side view illustrating the opening and closing movements of the door of the assembly.

With reference specifically to FIGS. 1, 2 and 4 to 6, the mounting frame 10 is formed by four members fastened together, preferably, in a generally square or rectangular arrangement. When installed in a ceiling as shown in FIG. 4, the members are generally horizontally disposed and form a space between them that receives the door 11. The four members comprise a hinge frame 21, a latch frame 22 and two side frames 23 and 24. With reference to FIG. 6, the hinge frame 21 has a Z-shape in cross section and includes a lower vertical part 26, a horizontal step part 27, an upper vertical part 28 and an upper step part 29. The latch frame 22 has a similar cross section as shown in FIG. 9 and the parts of the latch frame are given the same reference numerals as used for the hinge frame 21. The two side frames 23 and 24 each include a vertical lower part 31, a horizontal step part 32 and an upper vertical part 33, again formed in a Z-shape as shown in FIGS. 4 and 5.

The four members 21, 22, 23 and 24 of the mounting frame 10 are made of metal and are secured together at their ends as by projection welds. The frame is mounted in the ceiling by two C channels 36 and 37 shown in FIGS. 2 and 4. The lower flange of each of the C channels 36 and 37 is positioned on the upper side of the horizontal step 32 of a side frame 23 or 24, and the webs of the two C channels 36 and 37 are postioned against the outside surfaces of the vertical parts 33 of the two side frames 23 and 24. The side frames 23 and 24 are secured to the two C channels 36 and 37 and the channels extend beyond the sides of the frame 10. The end portions of the two C channels 36 and 37 are secured to the undersides of two forming channels 38 (only one channel 38 being shown in FIG. 4), and the channels 38 in turn are secured to the bar joists 14, thereby rigidly securing the frame 10 to the bar joist 14 and the underside of the slab 16. The channels 36 and 37 are interconnected with the ceiling channels 13 and the frame 10 is at the level of the ceiling panels 12 as shown in FIG. 4.

Figure 1:
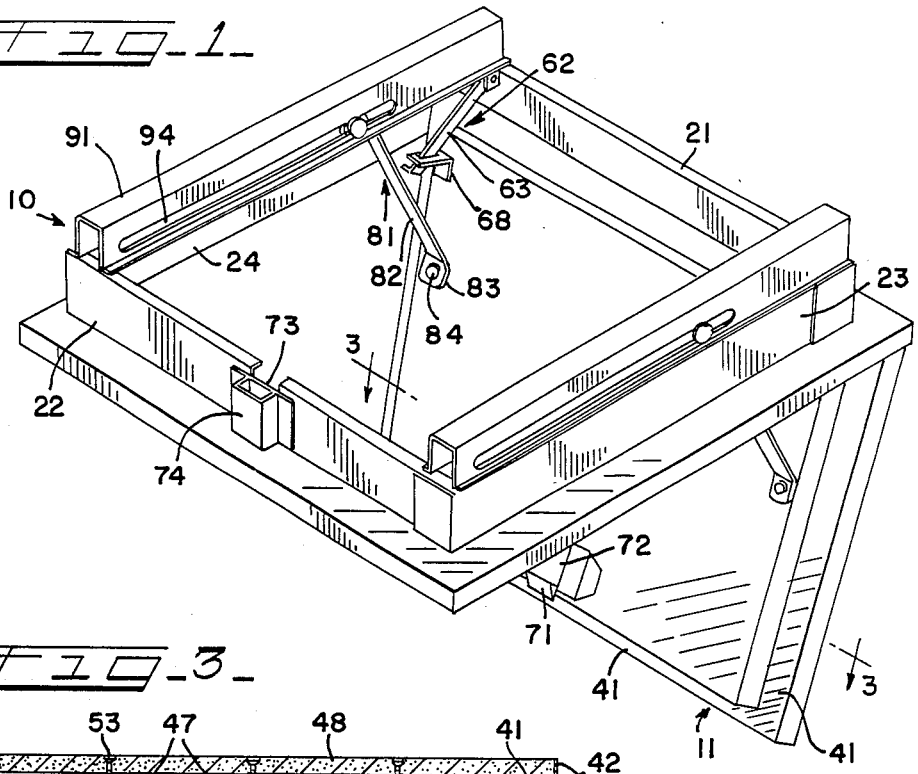
FIG. 1 is a perspective view of an access door assembly in accordance with the invention, showing the door in the open position.
Figure 3:
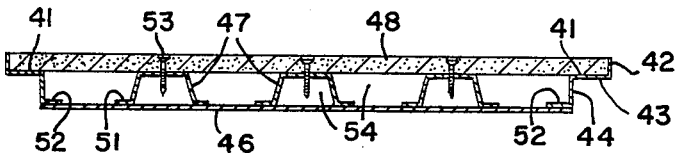
FIG. 3 is a sectional view taken on the line 3—3 of FIG. 1.

With specific reference to FIGS. 1, 3 and 4, the door 11 is formed by four similar metal sides 41 which are interconnected to form a generally square or rectangular frame which is received in the mounting frame 10 as shown in FIG. 4. As shown in the drawings, the outer horizontal dimensions of the door 11 are slightly less than those of the frame 10 and the door is snugly received in the opening formed by the frame. Each of the sides 41 has a Z-shape in cross section and includes a lower vertical part 42, a horizontal step part 43 and an upper vertical part 44. As shown in dashed lines in FIG. 6 and also in FIGS. 4 and 9, the parts of the door sides are positioned closely adjacent and mate with the corresponding parts of the frame members 21 of the mounting frame, the parts thus forming a narrow tortuous path between them in order to limit or retard the flow of heat or spread of fire upwardly between the sides of the door 11 and the mounting frame 10.

The door 11 further includes a flat top panel 46 (FIG. 4), a plurality of channel stiffeners 47, and a fire resistive board facing 48. The edges of the board facing 48 are received in the recesses formed by the lower vertical parts 42 and the steps 43 of the door sides 41, as best shown in FIG. 3. The stiffeners 47 are positioned between the board facing 48 and the top panel 46, the channel stiffeners 47 including flanges 51 which are fastened to the top panel 46 as by spot-welding. The outer periphery of the top panel 46 is also fastened as by spot-welding to flanges 52 of the four sides 41 of the door. Screws 53 extend through openings formed in the board facing 48 and are threaded into the webs of the stiffeners 47 in order to secure the board facing 48 to the stiffeners 47. The stiffeners 47 further form air voids 54 between the board facing 48 and the top panel 46 which serves to heat insulate the space above the ceiling from the space below the ceiling. As shown in FIG. 4 and in dashed lines in FIG. 6, when the door 11 is closed, the lower horizontal surface of the board facing 48 is flush with the lower edges of the members 21–24 and 41 and flush with the lower horizontal surface of the ceiling panels 12.

It is a feature of the present invention that the fire resistive board facing 48 is made from a blend primarily of ceramic ($SiO_2$) fibers and alumina ($Al_2O_3$) saffil fibers, and has excellent heat-temperature characteristics. A suitable product of this nature is sold by Kaowool Millboard Company and is identified a the ½ inch thick ceramic fiber M board.

As previously mentioned, the door 11 is sized to be snugly received within the opening of the mounting frame 10 as shown in FIG. 4, and one edge of the door is hingedly connected to the mounting frame 10. As best shown in FIGS. 5 and 6, one of the sides 41 of the door is connected by a hinge 61 to the hinge frame 21 of the mounting frame 10. The hinge 61 is preferably a continuous hinge which extends substantially the full length of the side 41 of the door, one leaf of the hinge being secured to the hinge frame 21 and the other leaf of the hinge being secured to the adjacent side 41. Consequently the door 11 may be swung between a closed position shown in FIGS. 2 and 4 where the lower surface of the facing 48 is flush with the lower surface of the ceiling panels 12, and an open position shown in FIGS. 1 and 6 and in dashed lines in FIG. 9 where the door 11 is swung about the axis of the hinge 61 to a location where the facing 48 hangs generally vertically downwardly. When the door is in the open position, the opening formed by the mounting frame 10 is accessible and a service person may reach the utilities through the opening.

To prevent an excessive amount of pivoting movement of the door toward the open position, a 90° open stop 62 is provided (see FIGS. 1, 5 and 6). The open stop 62 includes a stop bar 63 which has one end pivotally connected by a pin 65 to a stop angle bracket 64 which in turn is secured as by spot welding to the hinge frame 21. The other end of the stop bar 63 is slidably connected to a slotted stop bracket 67 which is fastened to the upper side of the top panel 46 of the door. The stop bracket 67 has an angle shape, one arm of the angle being secured to the top panel 46 and the other arm extending outwardly and having a slot 68 (see FIG. 1) formed in it, the bar sliding in the slot 68. The end of the bar 63 that is connected in the bracket 67 has a right-angle turn 69 formed on it at a position where, when the door 11 reaches the generally vertical position, the right-angle turn 69 engages the bracket 67 (FIG. 5) and prevents further opening movement of the door.

A latch (FIGS. 1 and 9) is further provided to hold the door in the closed position, and the latch is self-engaging. The latch comprises a bolt 71 that is mounted on the upper side of the top panel 46 adjacent the latch frame 22 of the mounting frame. The bolt 71 is mounted in a housing 72 and is urged outwardly to its engaged position by a bolt spring (not shown). Mounted on the latch frame 22 at a position to be engaged by the bolt 71 is a keeper 73 and a cover 74. The keeper 73 has an opening (shown in FIG. 9) formed in it which receives the bolt 71 when the door is swung to its closed position. One side of the bolt 71 is bevelled as shown in FIG. 9 so that the bolt 71 is cammed inwardly as the door is closed and then is spring forced out into the engaged position in order to hold the door closed. The latch further includes a keyway 75 (FIG. 9) which appears on the underside of the facing 48, the keyway enabling a service man to insert a key into the latch in order to retract the bolt 71 and open the door from below the ceiling. The specific details of the spring bolt and its housing 72, and the keeper 73 and the keyway 75 are conventional and these details do not form part of this invention.

An important feature of this invention is the provision of a spring return mechanism 81 for moving the door 11 to the closed position, the return mechanism 81 being best shown in FIGS. 1, 8 and 9. Consequently the door cannot accidentally be left open by a service person (and thereby lose the fire retardant feature), and the latch will automatically engage and hold the door closed when it swings shut. The return mechanism 81 exerts a constant force, regardless of the angular position of the door relative to the frame, on the door 11 to return the door to the closed position. The use of a constant force return mechanism is highly advantageous in the present construction because the door will not tend to slam shut upon closing. A hard closing of the door is disadvantageous first because it would produce a shock which might damage the ceiling panels or the door facing, and secondly because a serviceman's fingers may become caught in the door and be injured if the door were to close with too hard a force.

Depending upon the size and weight of the door, one or two return mechanisms 81 may be provided. Two mechanisms 81 are shown in this example but only one will be described in detail because they are essentially identical.

Each return mechanism 81 comprises a spiral metal strip 82 which has one end 83 fastened to the upper side of the top panel 46 of the door 11 by a suitable fastener 84. The metal strip 82 extends upwardly from the door 11 and is wound on a spring drum 86 (see FIG. 8), the drum 86 being mounted on a grooved shaft 87. The drum 86 has radially extending end flanges 88 at its opposite ends and the strip 82 is wound between the flanges 88, the flanges 88 thereby forming guides for properly reeling the strip 82 on the drum 86.

The shaft 87 and the drum 86 are mounted on a track 91 (FIGS. 1 and 7 to 9) which is fastened to the upper side of the mounting frame 10 as shown in FIG. 1. Since in the present instance, two return mechanisms 81 are provided, two tracks 91 are also provided. Each track 91 has an inverted U-shape in cross section and includes two vertically extending walls 92 connected by a web 90. Each channel 91 further includes a downwardly extending mounting flange 93 which is secured as by spot-welding to the two side frames 23 and 24 of the mounting frame 10 (see FIG. 5). The two vertical walls 92 have aligned horizontally extending slots 94 formed in them and the shaft 87 of the drum 86 extends through the slots 94. Each end of the shaft 87 has an annular groove 96 which engages the edges of a slot 94 in order to guide the shaft 87 as it rolls along the length of the two slots 94. As shown in FIG. 8, the channel of the track 91 is sufficiently high that it is able to receive the spring drum 86 which moves along the length of the track as the door opens and closes.

The strip 82 is known as a constant force extension spring and may be of the type sold by the Hunter Springs Division of Ametek Corporation. The strip 82 has a built in or inherent spring force which tends to move it to a tightly coiled configuration. When the strip 82 is unreeled or pulled straight downwardly as shown in solid lines in FIG. 1 and in dashed lines in FIG. 9, the tendency to recoil itself on the drum 86 causes a force to be exerted on the door tending to move the door to the closed position, and this closing force is substantially constant. Further, the drum 86 and the shaft 87 are free to move along the length of the slots 96 of the track 91 as the door moves between the open and closed positions. Consequently when the door 11 is in the closed position as shown in solid lines in FIG. 9, the drum 86 moves to a position which is substantially directly above the end 83 which is fastened to the door. When the door 11 is swung downwardly and the end 83 moves downwardly and toward the right as seen in FIG. 9, the drum 86 also moves along the length of the track 91 because the spring force tends to make the unreeled portion of the strip as short as possible. Consequently the drum 86 moves to a location which is substantially directly above the other end 83 which is fastened to the door.

The center of gravity of the door 11 is indicated by the letters CG in FIG. 9, and the center of gravity also swings in an arcuate path when the door opens and closes. The strip 82, however, always is to the left of the center of gravity regardless of whether the door is opened or closed because of the fact that the drum 86 is able to move freely along the track. Since the strip 82 remains to the left of the center of gravity, it always exerts a closing force on the door.

Figure 2:
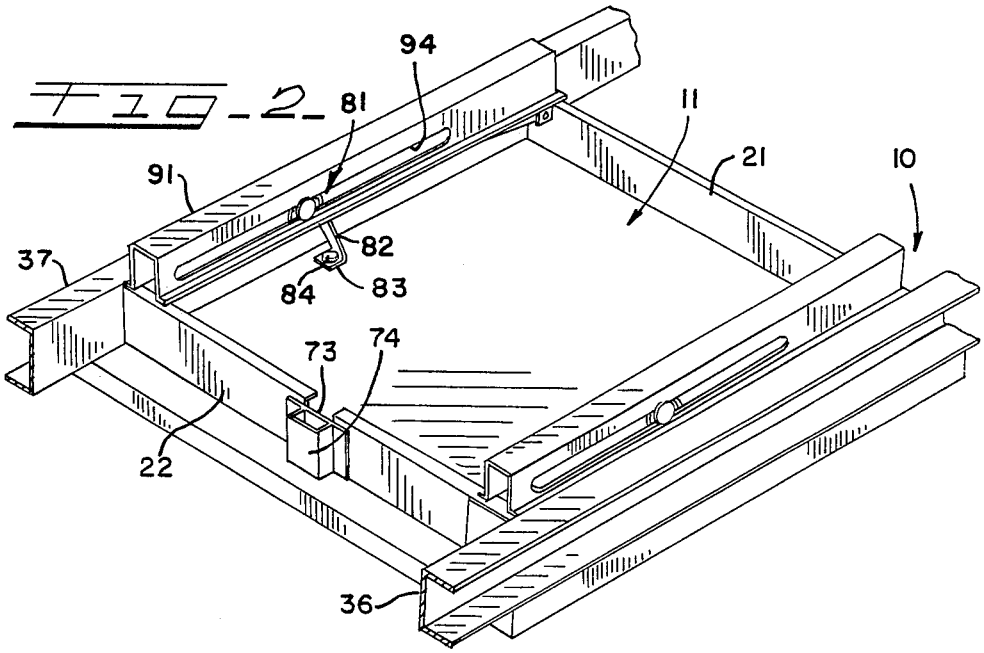
FIG. 2 is a perspective view of the assembly shown in FIG. 1 with the door in the closed position.
Figure 7:
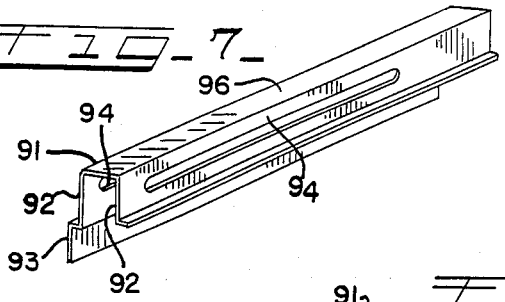
FIG. 7 is a perspective view of a track of the assembly.

It will be apparent from the foregoing that an improved access door has been provided having a number of advantageous features. When the door is closed as shown in FIGS. 2 and 4, it is substantially flush with the ceiling panels and presents a pleasing aesthetic appearance. The close fitting arrangement of the sides of the door with the side frames of the mounting frame 10 form a tortuous path between them which retards the flow of heat and flames upwardly from the space below to the utilities above the ceiling. The board facing is also advantageous in that it is made of ceramic fiber which is strong, light weight and has excellent heat-resistant characteristics.

The provision of the return mechanism also is important in that it returns the door 11 to the closed position after it has been opened by a serviceman. It is important for fire protection purposes that the door be closed under normal circumstances, and the return mechanism thereby ensures that the door will not be left accidentally in the open position after servicing. The latch automatically engages when the door moves to the closed position and thereby holds the door closed unless it is intentionally opened by a serviceman. The provision of the constant force return mechanism is highly advantageous because it moves the door to the closed position and at the same time prevents the door from slamming shut with an excessive amount of force. If the door were to slam shut, as previously mentioned, the door or the adjacent ceiling panels might be damaged, or a serviceman may have his fingers injured if they happened to be caught in the door. The combination of the constant force extension strip 82 and the movable axis of the drum 86 ensure that the door will be closed by a soft steady force. The 90° open stop prevents the door from swinging beyond the 90° position shown in FIG. 6 and thereby protects the return mechanism from damage which might occur if the door were opened farther than the 90° position.

While the access door assembly is shown in use with a steel and concrete slab building construction, it should be understood that it may also be used in other types of buildings, such as those with a timber construction.

What is claimed is:

1. An access door assembly for a ceiling, comprising a mounting frame adapted to be mounted in a ceiling, a door hingedly attached to said frame and movable between an open position and a closed position relative to said frame, and a return mechanism connected between said frame and said door for urging said door to said closed position, said return mechanism comprises a substantially constant force spring, wherein said spring is an elongated strip, said mechanism further comprising a spring drum and said strip being coiled on said drum when said door is in said closed position, and a track fastened to said mounting frame, said drum being movably mounted on said track.

2. An access door assembly for a ceiling, comprising a mounting frame adapted to be mounted in a ceiling, a door hingedly attached to said frame and movable between an open position and a closed position relative to said frame, and a return mechanism connected between said frame and said door for urging said door to said closed position, said return mechanism comprises a substantially constant force spring, wherein said spring is an elongated strip, said mechanism further comprising a spring drum and said strip being coiled on said drum when said door is in said closed position, and a track fastened to said mounting frame, said drum being movably mounted on said track wherein said strip has a free end attached to said door, said drum moving to a position close to and substantially above said free end when said door is in said closed position, and said drum moving to adjacent the hinge attachment between said door and same frame when said door is in said open position.

3. An access door assembly for a ceiling, comprising a mounting frame adapted to be mounted in a ceiling, a door, a hinge attaching said door to said frame whereby said door is movable between an open position and a closed position relative to said frame, a track fastened to said mounting frame, a spring having a fixed end attached to said door and a movable end connected to said track, said movable end moving along said track during movement between said open and closed positions, said door having a center of gravity, and said movable end remaining generally above said center of gravity during said movement along said track.

4. An access door assembly as in claim 3, wherein said spring is a substantially constant force spring.

* * * * *